US005475895A

United States Patent [19]

Gain

[11] Patent Number: 5,475,895

[45] Date of Patent: Dec. 19, 1995

[54] TOOL HAND GRIP

[76] Inventor: Gregg F. Gain, 2501 Sherman Ave. #150, Coeur d'Alene, Id. 83814

[21] Appl. No.: 202,639

[22] Filed: Feb. 28, 1994

[51] Int. Cl.[6] ..... A47B 95/02

[52] U.S. Cl. ..... 16/111 R

[58] Field of Search ..... 16/111 R, 110 R, 16/118, 121, DIG. 12, DIG. 30, DIG. 41; 81/177.1, 490; D8/25, 82, 83, 84, 85, 86, 300, 303

[56] References Cited

U.S. PATENT DOCUMENTS

| | | | |
|---|---|---|---|
| D. 271,937 | 12/1983 | Combs | 16/111 R |
| D. 274,086 | 5/1984 | Yanagi | 16/DIG. 30 |
| D. 330,319 | 10/1992 | Linderman et al. | D8/300 |
| 1,632,227 | 6/1927 | Halsey | 16/121 |
| 2,091,458 | 8/1937 | Sleight | 16/111 R |
| 2,725,086 | 11/1955 | Keyes et al. | 16/DIG. 12 |
| 3,600,982 | 8/1971 | Tholen | 81/3.48 |
| 4,616,673 | 10/1986 | Bondar | 16/121 |
| 4,739,536 | 4/1988 | Bandera et al. | 16/111 R |

*Primary Examiner*—P. Austin Bradley
*Assistant Examiner*—Chuck Y. Mah

[57] ABSTRACT

A new and improved tool hand grip for providing a hand grip for pole-handled joint taping tube which increases leverage and frictional engagement between a user's hand and the tube's shank thereby improving tool control and reducing user fatigue. The tool hand grip comprises a ring having parallel planar ends. The ring also has a generally smooth central bore therethrough. The ring additionally has an outside diameter substantially greater than the diameter of the central bore. The ring is frictionally engaged with the tool shank whereby the user may grasp the outside of the hand grip to obtain improved purchase on the tool shank.

1 Claim, 3 Drawing Sheets

TOOL HAND GRIP

BACKGROUND OF THE INVENTION

1. Field of the Invention

The present invention relates to hand grips and more particularly pertains to tool hand grips which may be adapted for providing a hand grip for pole-handled joint taping tube which increases leverage and frictional engagement between a user's hand and the tube's shank thereby improving tool control and reducing hand strain and user fatigue.

2. Description of the Prior Art

The use of tool hand grips is known in the prior art. More specifically, tool hand grips heretofore devised and utilized for the purpose of improving a user's grip on a tool are known to consist basically of familiar, expected and obvious structural configurations, notwithstanding the myriad of designs encompassed by the crowded prior art which have been developed for the fulfillment of countless objectives and requirements.

The present invention is directed to improving devices for providing a hand grip for pole-handled joint taping tube which increases leverage and frictional engagement between a user's hand and the tube's shank thereby improving tool control and reducing hand strain and user fatigue in a manner which is safe, secure, economical and aesthetically pleasing.

For example, U.S. Pat. No. 4,031,775 to Petty discloses a hand grip for use on handle bars of a motor vehicle which has a hand-gripping section having a finger-gripping means defining intersecting planar surfaces and palm-gripping means defining a semi-circular area having spaced ribs therealong, a torus-shaped thumb guard at one end and a bulbous section at the other end.

U.S. Pat. No. 4,981,737 to Rico describes a vibration damping tool wrap in the form of a flat laminate of specific size and shape so as to conform generally to a tool handle of specific size and shape when wrapped therearound.

The prior art also discloses moldable hand grips as shown in U.S. Pat. Nos. 5,155,878 and 4,785,495 both to Dellis which consist of hand grips for applying to motorcycles, bicycles, tools, golf clubs, fishing rods, guns, crutches and the like which can be custom molded to fit exactly to the contours of the user's hand. The grip includes a thermoplastic resin component which is heated to a molding temperature then impressed with the user's hand to produce an individualized grip after hardening of the resin.

Another moldable grip is shown in U.S. Pat. No. 4,934,024 to Sexton which is comprised of a deformable cover formed of a thermoplastic material which is stable and semi-rigid at normal ambient temperatures and is soft and deformable when heated in boiling water. The cover is attached to an implement handle heated and deformed to the shape required by a specific implement user.

While these devices fulfill their respective, particular objectives and requirements, the aforementioned patents do not disclose a tool hand grip for providing a hand grip for pole-handled joint taping tube which increases leverage and frictional engagement between a user's hand and the tube's shank thereby improving tool control and reducing hand strain and user fatigue.

In this respect, the tool hand grip according to the present invention substantially departs from the conventional concepts and designs of the prior art, and in so doing provides an apparatus primarily developed for the purpose of providing a hand grip for pole-handled joint taping tube which increases leverage and frictional engagement between a user's hand and the tube's shank thereby improving tool control and reducing hand strain and user fatigue.

Therefore, it can be appreciated that there exists a continuing need for new and improved tool hand grips which can be used for providing a hand grip for pole-handled joint taping tube which increases leverage and frictional engagement between a user's hand and the tube's shank thereby improving tool control and reducing hand strain and user fatigue. In this regard, the present invention substantially fulfills this need.

As illustrated by the background art, efforts are continuously being made in an attempt to develop devices for improving a user's grip on a tool. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of tool hand grips now present in the prior art, the present invention provides an improved tool hand grip construction wherein the same can be utilized for providing a hand grip for pole-handled joint taping tube which increases leverage and frictional engagement between a user's hand and the tool tube's thereby improving tool control and reducing hand strain and user fatigue. As such, the general purpose of the present invention, which will be described subsequently in greater detail, is to provide a new and improved tool hand grip apparatus and method which has all the advantages of the prior art tool hand grips and none of the disadvantages.

The invention is defined by the appended claims with the specific embodiment shown in the attached drawings. For the purpose of summarizing the invention, the invention may be incorporated into a new and improved tool hand grip for providing a hand grip for pole-handled joint taping tube which increases leverage and frictional engagement between a user's hand and the tube's shank thereby improving tool control and reducing hand strain and user fatigue. The tool hand grip comprises a ring formed of resilient non-slip material, such as rubber, having parallel planar ends. The ring has a generally smooth central bore therethrough, the bore having a diameter for slidable receipt of the tube shank and for a tight fit around the tube shank with which it is used. The ring also has an outside diameter substantially greater than the diameter of the central bore. The ring additionally has a plurality of longitudinal corrugations formed along it's outside circumference, the corrugations having a depth and a spacing capable of receiving fingers of an adult hand with a parallel planar end positioned in a palm of the hand. The ring is frictionally engaged with the tube shank such that the shank of the tube extends through the bore and the user grasp the outside of the ring, using the corrugations thereon for tube control through the use of the hand grip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a tool hand grip for providing a hand grip for pole-handled tools, such as joint tape tubes or the like, which increases leverage and frictional engagement between a user's hand and the tool shank thereby improving tool control and reducing user fatigue.

It is therefore an additional object of the present invention to provide a new and improved tool hand grip which has all the advantages of the prior art tool hand grips and none of the disadvantages.

It is another object of the present invention to provide a new and improved tool hand grip which may be easily and efficiently manufactured and marketed.

It is a further object of the present invention to provide a new and improved tool hand grip which is of a durable and reliable construction.

An even further object of the present invention is to provide a new and improved tool hand grip which is susceptible of a low cost of manufacture with regard to both materials and labor, and which accordingly is then susceptible of low prices of sale to the consuming public, thereby making such tool hand grips economically available to the buying public.

Still yet another object of the present invention is to provide a new and improved tool hand grip which provides in the apparatuses and methods of the prior art some of the advantages thereof, while simultaneously overcoming some of the disadvantages normally associated therewith.

Still yet another object of the present invention is to provide a new and improved tool hand grip which is designed and constructed to be operable without modification by a large number of users.

Yet another object of the present invention is to provide a new and improved tool hand grip that may be easily and inexpensively adapted for use with a large variety of different tools.

Even still another object of the present invention is to provide a new and improved tool hand grip that can be adapted to existing tools or incorporated into newly designed tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
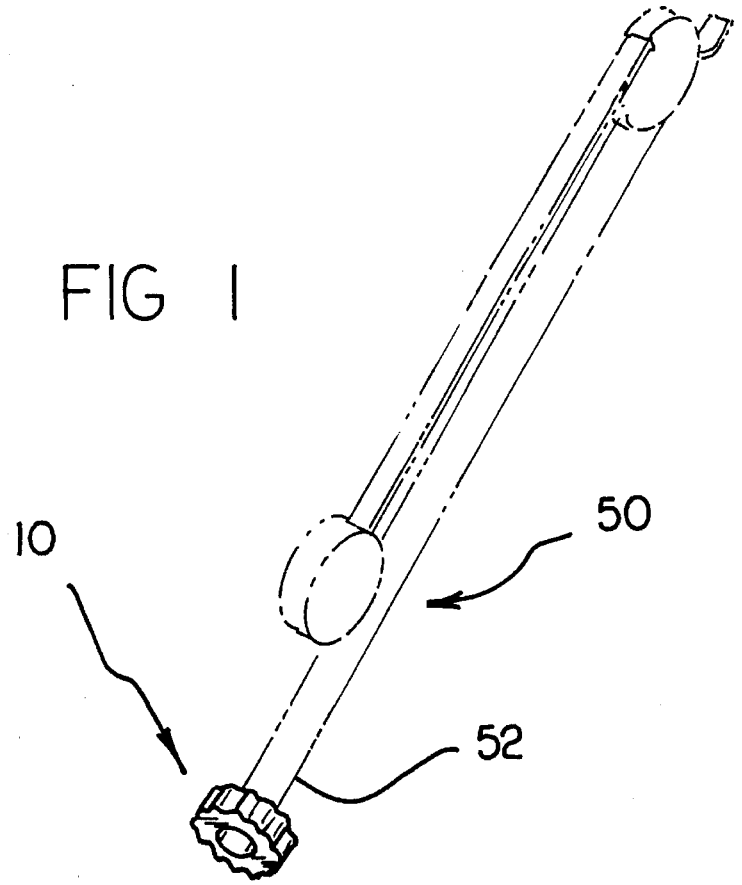
FIG. 1 is a perspective view of the new and improved tool hand grip illustrating its manner of installation.
Figure 2:
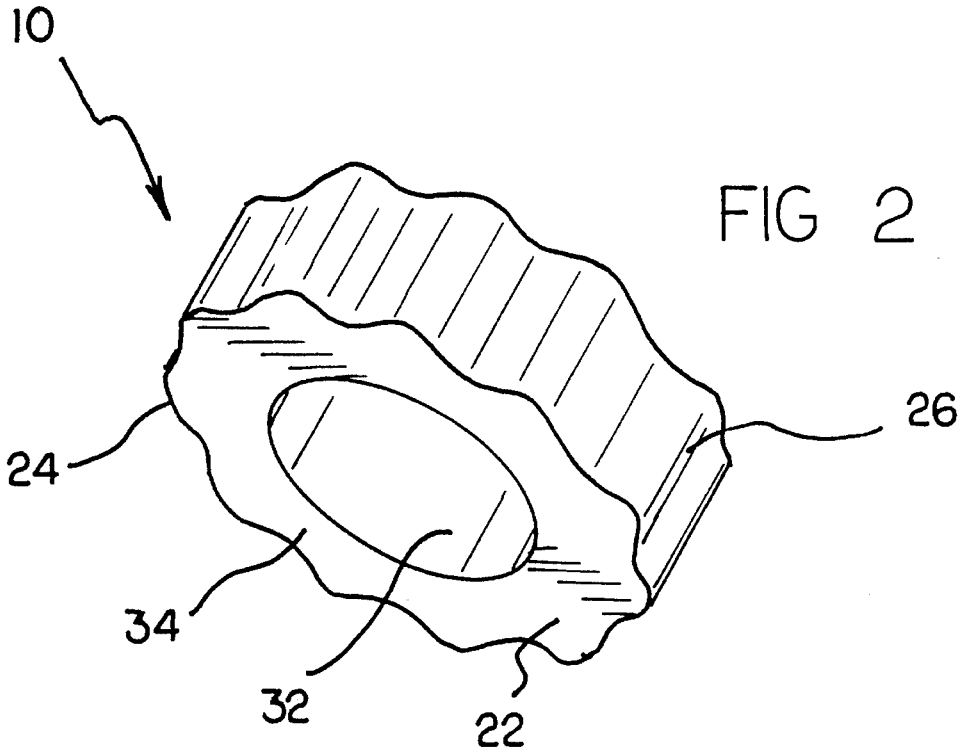
FIG. 2 is a perspective view of the present invention.
Figure 3:
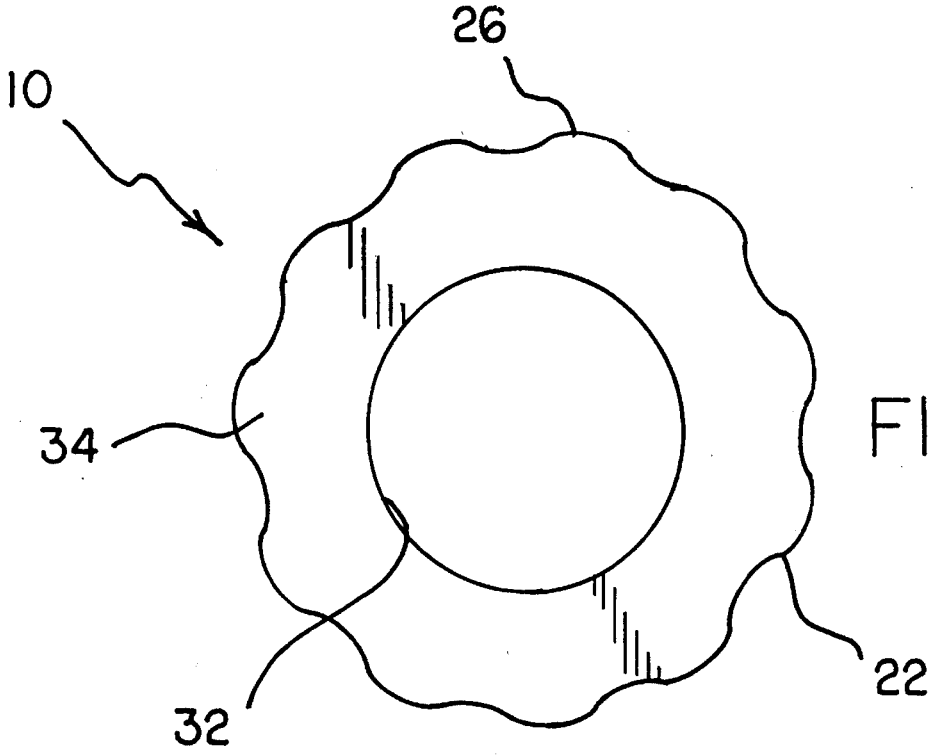
FIG. 3 is a top plan view of the present invention.
Figure 4:
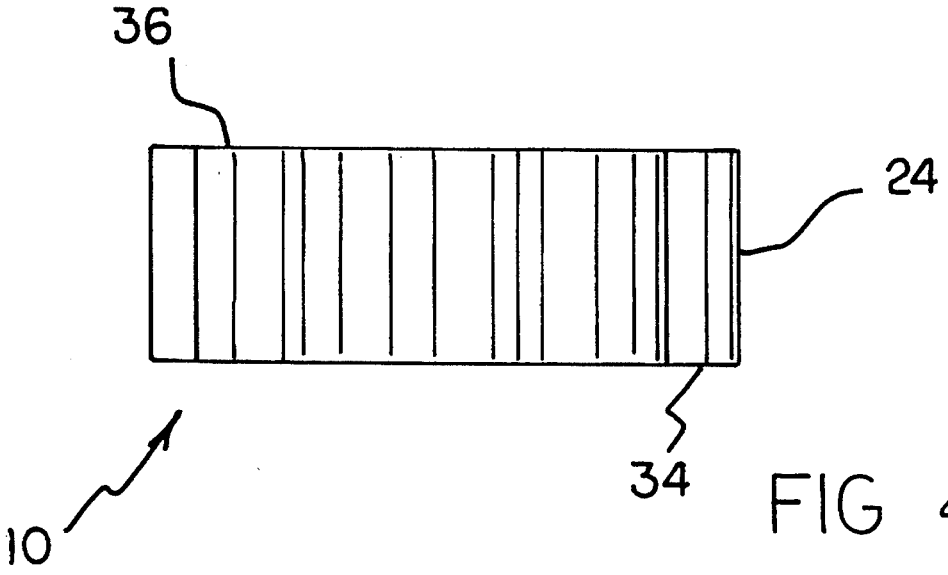
FIG. 4 is a side elevational view of the present invention.

With reference now to the drawings, and in particular to FIG. 1 thereof, a new and improved tool hand grip embodying the principles and concepts of the present invention and generally designated by the reference numeral 10 will be described.

Figure 5:
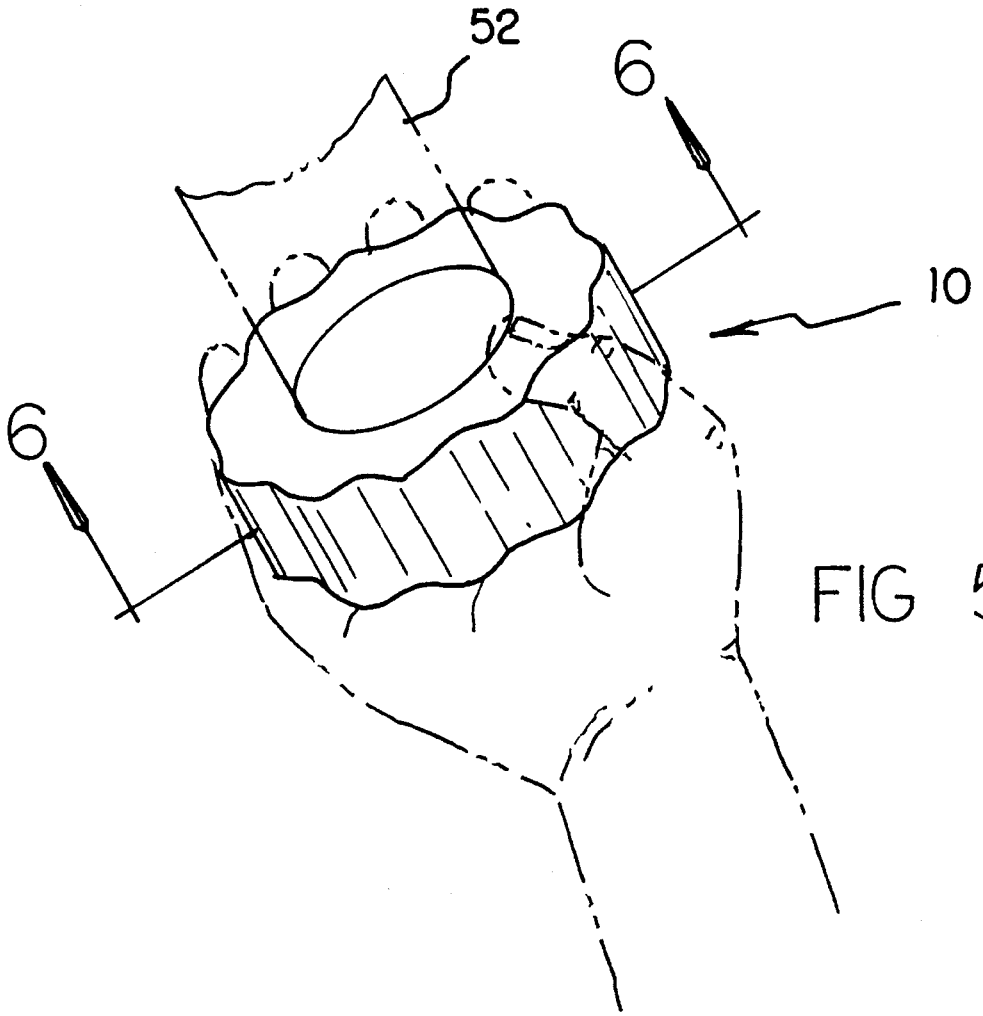
FIG. 5 is a perspective view of the invention of FIG. 1 showing its manner of use.
Figure 6:
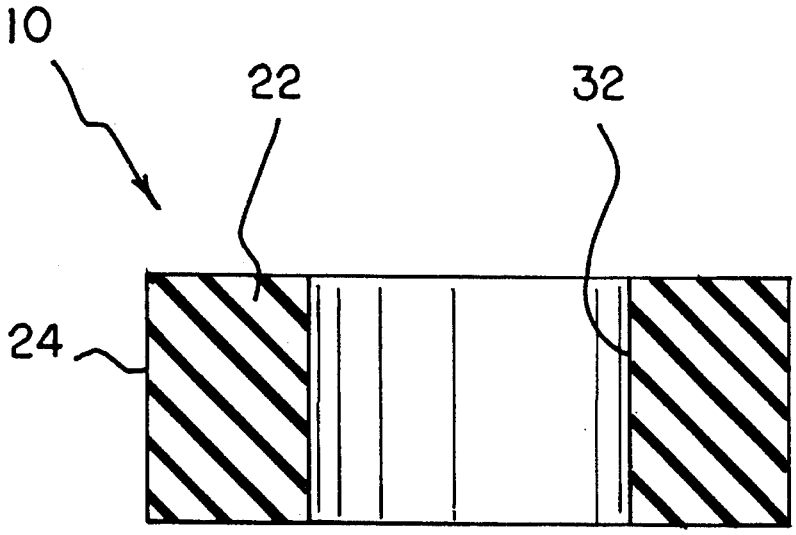
FIG. 6 is a sectional view of the invention of FIG. 5 taken along the line 6—6.

From an overview standpoint, the tool hand grip is adapted for use with providing a hand grip for pole-handled joint taping tube which increases leverage and frictional engagement between a user's hand and the shank thereby improving tool control and reducing hand strain and user fatigue. See FIG. 5.

With reference now to FIGS. 1–6 and more specifically, it will be noted that a new and improved tool hand grip 10 for providing a hand grip for pole-handled joint taping tube 50, such as which increases leverage and frictional engagement between a user's hand and the tube shank thereby improving tool control and reducing hand strain and user fatigue.

The tool hand grip 10 comprises a ring 22 formed of resilient non-slip material, such as rubber, having parallel planar ends 34 and 36. The ring 22 has a generally smooth central bore 32 therethrough, the bore 32 having a diameter for slidable receipt of the tube shank and for a tight fit around the tube shank. The ring 22 also has an outside diameter 24 substantially greater than the diameter of the central bore 32. The ring 22 additionally has a plurality of longitudinal corrugations 26 formed along it's outside circumference, the outside circumference has a smooth surface the corrugations 26 having a depth and a spacing capable of receiving fingers of an adult hand.

The ring 22 is frictionally engaged with the tube shank 52 such that the shank 52 of the tube 50 extends through the bore 32 whereby the user grasp the outside of the grip 10, using the corrugations 26 thereon for tube control through the use of the hand grip 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved tool hand grip for providing a hand grip for a pole-handled joint taping tube which increases leverage and frictional engagement between a user's hand and the tube's shank thereby improving tool control and reducing hand strain and user fatigue, the tool hand grip comprising:

a ring of resilient non-slip material having a pair of parallel planar ends, a generally smooth central bore therethrough capable of receiving a taping tube shank and a plurality of longitudinal corrugations on an outside circumference thereof, the outside circumference having a smooth surface, the bore having a diameter for slidable receipt of the tube shank and for a tight fit around the tube shank, the ring having an outside diameter substantially greater than the diameter of the central bore, the corrugations having a depth and a spacing capable of receiving fingers of an adult hand with one of said parallel planar ends positioned in a palm of the hand, said ring is capable of being frictionally engaged with the tube shank such that the shank of the tube extends through the bore and the user can grasp the outside of the ring using the corrugations thereon for tube control through the use of the hand grip.

* * * * *